US008707773B2

(12) United States Patent
Blossfeld et al.

(10) Patent No.: US 8,707,773 B2
(45) Date of Patent: Apr. 29, 2014

(54) METHOD OF MONITORING OIL IN A VEHICLE

(75) Inventors: Daniel H. Blossfeld, Novi, MI (US); Matthew J. Snider, Howell, MI (US); James L. Linden, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 925 days.

(21) Appl. No.: 12/857,638

(22) Filed: Aug. 17, 2010

(65) Prior Publication Data

US 2012/0046920 A1 Feb. 23, 2012

(51) Int. Cl.
*G01M 15/04* (2006.01)

(52) U.S. Cl.
USPC ..... 73/114.55

(58) Field of Classification Search
USPC ..... 73/53.05, 54.01, 114.55, 114.56
See application file for complete search history.

(56) References Cited

U.S. PATENT DOCUMENTS 5,750,887 A * 5/1998 Schricker ..... 73/114.55
6,741,938 B2 * 5/2004 Berndorfer ..... 702/23
6,776,024 B2 * 8/2004 Jakoby ..... 73/10
6,917,865 B2 * 7/2005 Arai et al. ..... 701/29.5
8,109,138 B2 * 2/2012 Han et al. ..... 73/114.55
8,359,912 B2 * 1/2013 Schneider et al. ..... 73/114.55
8,392,054 B2 * 3/2013 Schneider et al. ..... 701/29.5
8,468,982 B2 * 6/2013 Johnson et al. ..... 123/1 A
2003/0083825 A1 * 5/2003 Berndorfer ..... 702/23
2003/0172722 A1 * 9/2003 Jakoby ..... 73/53.05
2004/0093150 A1 * 5/2004 Arai et al. ..... 701/104
2010/0122571 A1 * 5/2010 Han et al. ..... 73/54.01
2012/0042718 A1 * 2/2012 Schneider et al. ..... 73/114.55
2012/0042719 A1 * 2/2012 Schneider et al. ..... 73/114.55
2012/0044065 A1 * 2/2012 Schneider et al. ..... 340/457.4
2012/0044077 A1 * 2/2012 Blossfeld et al. ..... 340/603
2012/0046823 A1 * 2/2012 Schneider et al. ..... 701/29.5

* cited by examiner

*Primary Examiner* — Eric S McCall
(74) *Attorney, Agent, or Firm* — Quinn Law Group, PLLC

(57) ABSTRACT

A method of monitoring oil in a vehicle having an internal combustion engine is provided. The method includes setting an original oil life, which is measured by event units occurring in the engine, and measuring a lapse of the event units. The method calculates a remaining oil life as a function of the lapse of event units and the original oil life. The remaining oil life is expressed in terms of the event units. The method monitors for oil additions and calculates an addition credit from any monitored oil additions. The method also includes calculating a modified oil life as a function of the addition credit, wherein the modified oil life is expressed in terms of the event units.

10 Claims, 2 Drawing Sheets

METHOD OF MONITORING OIL IN A VEHICLE

TECHNICAL FIELD

This disclosure relates to monitoring of oil and oil life in internal combustion engines.

BACKGROUND

Various internal combustion engines utilize motor oil or engine oil for lubrication of moving parts, such as pistons and shafts. Gasoline engines and diesel engines both use motor oil derived from petroleum and non-petroleum base materials, and many include additive components. Most engines require periodic maintenance, which may include changing the oil, adding oil, or changing other components of the engine oil system. Depending upon the type of engine, the type of vehicle, the operating environment, and other factors, the maintenance schedule or cycle may vary.

SUMMARY

A method of monitoring oil in a vehicle having an internal combustion engine is provided. The method includes setting an original oil life, which is measured by event units occurring in the engine, and measuring a lapse of the event units. The method calculates a remaining oil life as a function of the lapse of event units and the original oil life. The remaining oil life is expressed in terms of the event units.

The method monitors for oil additions and calculates an addition credit from any monitored oil additions. The method also includes calculating a modified oil life as a function of the addition credit, wherein the modified oil life is expressed in terms of the event units.

The modified oil life may be determined by adding event units to the remaining oil life as a function of the addition credit. Furthermore, the modified oil life may be equal to the remaining oil life plus the proportion of the monitored oil addition relative to a sump volume, multiplied by the original oil life.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
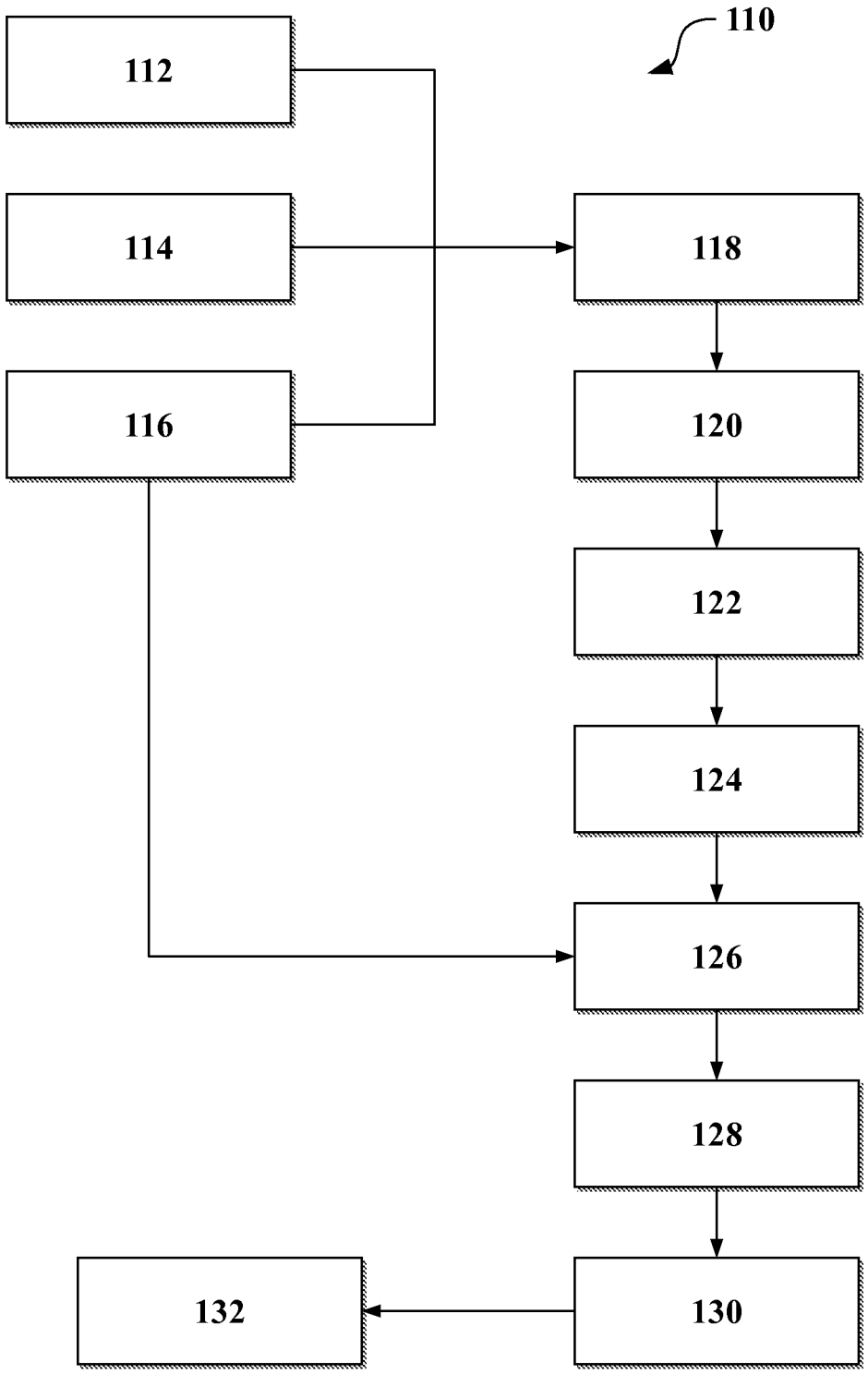
FIG. 1 is a schematic flow chart of an algorithm or method for calculating engine oil life.

Referring to the drawings, wherein like reference numbers correspond to like or similar components throughout the several figures, there is shown in FIG. 1 a schematic flow chart of a method or algorithm 110 for monitoring engine oil quality or engine oil life. The algorithm 110 may be used with an internal combustion engine and may be a component or sub-algorithm of an engine oil life system. The algorithm 110 is capable of determining or estimating the remaining life of engine oil, including accounting for additions of new or fresh oil between regular maintenance or oil changes.

Generally, oil life or life span refers to the suitable life of oil before it begins to lose effectiveness in the engine. For example, when oil is evaluated on the Global Oil Deterioration Index (GODI), the life span may be considered to be the range from 0.0 to 0.5 on the GODI. The GODI begins at 0.0, for fresh oil, and increases as the oil degrades. However, actual effective life span of any specific oil in a specific vehicle may vary, such that oil having a GODI of greater than 0.5 may still provide effective oiling and oil having a GODI of less than 0.5 may not provide effective oiling. Vehicles often have regular maintenance or oil changes scheduled based upon the predicted or measured life span of the oil.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

The algorithm 110 may become operational at any time when the engine is running or during diagnostic testing. The algorithm 110 is illustrated as for a single loop or iteration, but may be continuously looping, have a fixed number of cycles, operate for a fixed time period, or may be started and stopped after any number of iterations. The algorithm 110 may be executed by a dedicated controller or computer, or may be one of many algorithms executed by a larger controller or computer such as the engine control module (ECM) or hybrid control processor (HCP). The exact order of the steps of the algorithm or algorithm 110 shown in FIG. 1 is not required. Steps may be reordered, steps may be omitted, and additional steps may be included.

Step 112: Engine Oil Type. Steps 112, 114, and 116 of the algorithm 110 involve logging, measuring, or calculating input parameters for the engine oil life calculations occurring as part of the algorithm 110. Step 112 inputs the type of engine oil being used. Depending upon the grade or type of oil used, due to varying bases and additives, the oil may have a differing life span.

Step 114: Engine Parameters. The size, configuration, and type of internal combustion engine may vary the oil life. The engine parameters may also include the age of the engine or the time since the last proper oil change and maintenance.

Step 116: Sump Volume. The size of the sump and the volume of oil contained therein affect the original oil life. The oil sump is a reservoir where oil pools or collects, often at the bottom of the engine. The sump may be a wet sump or a dry sump. Sump oil may be redistributed to the engine through an oil pump and an oil filter. The algorithm 110 may assume that the volume of oil is a predetermined percentage of the sump volume—possibly based upon the recommended amount of oil added during an oil change.

Step 118: Calculate Original Oil Life. The algorithm 110 set an original oil life or original oil life target. The original oil life is calculated from all of the input parameters, such as those collected in steps 112, 114, and 116, in addition to other parameters.

The algorithm 110 may include numerous other input parameters in calculating the original oil life. The original oil life may alternatively be set at a predetermined value based upon an assumption that the oil has been changed within predetermined constraints or manufacturer guidelines. Therefore, instead of measuring or calculating input parameters, the controller may assume that predetermined parameters have been met and simply select the correct original oil life. This may be done, for example, when a service technician or the vehicle operator triggers a reset switch alerting the controller that the oil has been changed and meets the predetermined guidelines.

The original oil life may be measured or expressed by numerous types of event units occurring within the engine, the vehicle, or both. For example, the original oil life may be 5000 miles driven by the vehicle, 5 calendar months, or 200 hours of drive time by the vehicle.

However, other event units which directly measure operation of the engine may also be used. For example, and without limitation, the event units may be one of engine revolutions and combustion events. In many vehicles combustion events and revolutions are directly related. However, in variable displacement engines, these events are not always directly proportional. The measured lapse of event units, and other measured or logged data, may also be averaged or integrated over a time period, and may be filtered or smoothed.

Step 120: Engine Event Unit Counter. The algorithm 110 measures the occurrence or lapse of the event units. Measuring lapse of the event units allows the controller to determine or compare the current or actual operation of the vehicle and engine to the original oil life target or estimate.

Step 122: Calculate Remaining Oil Life. The algorithm 110 calculates a remaining oil life as a function of the lapse of event units and the original oil life. The remaining oil life may also be expressed in terms of the event units. The remaining oil life may be expressed mathematically as the measured lapse of event units subtracted from the original oil life (where the original oil life is expressed in terms of event units), as expressed in the formula:

$$\text{REMAINING}=\text{ORIGINAL}-\text{LAPSE}$$

Alternatively, an adjustment factor may be included in the calculation of the remaining oil life. For example, and without limitation, an error factor may be included to account for errors in measurement of the lapse of event units from step 122, or a driving style factor may be included to adjust for the driving style of the vehicle operator.

Step 124: Oil Addition. The algorithm 110 monitors the vehicle and the engine for an oil addition. When the operator of the vehicle or an automotive service technician adds oil to the engine or the sump, the controller registers the amount and time of the oil addition. The operator may add fresh oil based upon a determination that the amount of oil in the sump is low or as a general habit. In either situation, the addition of fresh oil may alter the effective life span of the oil between scheduled maintenance or oil changes.

The algorithm 110 may monitor the oil addition in various ways and with various mechanisms. Monitoring for oil additions may include receiving a signal from an operator of the vehicle. For example, and without limitation, when the operator adds oil the operator may input that occurrence and communicate the oil addition to the controller via the instrument panel, a dashboard computer system (such as those having navigation, entertainment, or climate controls), or an input device (such as a button) mounted in the engine compartment.

Alternatively, the controller may be in communication with sensors equipped to monitor for oil additions without input from the driver. In such a configuration, the step 124 registers the oil addition without action on the part of the operator. For example, and without limitation, the oil cap may include a sensor which registers that the oil cap was removed and an object (such as a funnel or the oil container) is place therein.

The controller may also determine the amount of oil added through similar operator inputs or similar sensors. For example, and without limitation, the sump may have an oil level sensor which detects the addition of oil as it collects in the sump, the oil cap may include a sensor which registers the time and duration when the oil cap is removed and an object (such as a funnel or the oil container) is placed therein, or the oil cap may include a flow meter configured to directly measure the amount of oil flowing into the engine. Alternatively, the algorithm 110 may use a predetermined volume value. For example, and without limitation, whenever a signal is received that an oil addition has occurred, the controller may assume that one quart of oil has been added.

Step 126: Calculate Addition Credit. The algorithm 110 calculates an addition credit from the monitored oil addition at step 126. The oil addition credit is a numeric representation of increased oil quality due to the contribution of the oil addition measured or logged in step 124. The fresh oil likely contains additives, some of which may have already been utilized by the oil previously in the engine. Therefore, the benefit of those new additives and fresh base oil may extend the life span of the oil between maintenance or oil changes. The addition credit may be a predetermined, fixed value.

Alternatively, the addition credit may be calculated by determining the proportion of the monitored oil addition relative to a sump volume of the engine. The proportion may be expressed by the formula:

$$\text{PROPORTION}=\frac{\text{OIL_ADDITION}}{\text{SUMP_VOLUME}}$$

the addition credit may be substantially equal to this proportion.

Alternatively, the addition credit may have a modification factor to account for possible errors in the estimated value of oil additions relative to the sump volume. Therefore the addition credit may be expressed by the formula:

$$\text{ADDITION_CREDIT}=\text{PROPORTION}*\phi$$

where the lowercase Greek letter phi represents the modification factor, which may be less than, equal to, or greater than one.

If the engine includes sensors monitoring the volume of oil added during step 124, the controller may directly determine the volumetric proportion of added oil to the total sump volume or to the beginning volume of oil at the last regular maintenance. However, if the controller is not directly monitoring the actual volume of oil in the sump or the actual volume of oil added, the algorithm 110 may use fixed values for either the sump volume or the volume added to determine the addition credit. For example, and without limitation, the controller may assume that the amount of fresh oil added was one quart and that the previous regular maintenance began the life cycle with five quarts in the sump. Therefore, the proportion would be 1 to 5 and the oil addition credit would be approximately 0.20 if no modification factor is used.

Step 128: Usage Factors. Algorithm 110 may include measuring or accounting for vehicle usage factors. These usage factors may include driving style, operating temperatures, and other factors which may alter the effective life span of the oil. Therefore, the additional credit may be adjusted by these usage factors. The usage factors may be positive or negative, such that the usage factors may increase or decrease the value of the addition credit.

Step 130: Calculate Modified Oil Life. The algorithm 110 calculates a modified oil life as a function of the addition credit. The modified oil life is an extension of the oil life span due to the oil addition, and may also be expressed in terms of the event units. If the modified oil life were not calculated, the controller would signal that the life span of the oil has expired and request an oil change regardless of whether any fresh oil had been added during the maintenance cycle.

The modified oil life may be determined by adding event units, as a function of the addition credit, to the remaining oil life. Therefore, the greater the addition credit determined in step 126, the longer the modified oil life will be extended beyond the remaining oil life before the fresh oil was added (as measured in step 124).

The modified oil life may be equal to the remaining oil life plus the addition credit multiplied by the original oil life. Therefore the modified oil life may be expressed by the formula:

MODIFIED=REMAINING+
ADDITION_CREDIT*ORIGINAL which is stored and calculated by the controller.

For illustrative purposes, the engine may begin a maintenance cycle with five quarts of fresh oil added (which is approximately the sump volume) and other maintenance tasks undertaken by a service technician. At step 118, the algorithm 110 uses the input parameters (such as those in steps 112-116) to calculate that the original oil life is approximately 5000 miles (where the algorithm 110 uses vehicle miles driven as the event units, instead of combustion events or engine revolutions). After the operator has driven the vehicle for approximately 3000 miles, as measured in step 120, step 122 would determine that the remaining oil life is approximately 2000 miles.

The operator may then decide to add one quart of engine oil. Step 124 logs the oil addition either by sensing the addition or by receiving an input signal from the operator. Step 126 then calculates the oil addition credit for the fresh oil. Based upon the sump volume and one quart oil addition, the proportion is calculated as 0.20. If there are no usage factors—such as extremely cold or extremely hot temperatures—the addition credit will also be calculated as 0.20.

At step 130, the algorithm 110 then calculates the modified remaining oil life and accounts for the oil addition by the operator of the vehicle. In this illustrative example, the oil addition adds approximately 1000 additional miles (0.20*5000 miles) to the oil life span. Therefore, by summing the additional miles and the remaining oil life, the modified oil life calculated in step 130 is approximately 3000 miles.

Step 132: Alert Receiver of Modified Oil Life. The algorithm 110 may alert a receiver of the modified oil life. The receiver may be part of the controller, may be a different component, or may be a display device (such as light on the instrument panel). If the vehicle is equipped with more-advanced communication capabilities—such as cellular, wireless internet, or satellite communications—the controller may broadcast the modified oil life to the communications network, thereby alerting the network, the operator, or a nearby service technician.

The vehicle may be configured such that the controller periodically, or upon request by the operator, notifies the operator of the remaining oil life or the modified oil life. For example, and without limitation, the operator may be able to press a button on the instrument panel to request a display of the remaining oil life (if no oil addition has occurred since the maintenance cycle began) or the modified oil life (if an oil addition has occurred). The remaining and modified oil life may be displayed in event units or as a percentage of the original oil life. In the illustrative example above, the operator may have viewed the remaining oil life, of approximately 2000 miles, calculated in step 122, and then decided to add one quart of fresh oil.

Furthermore, in situations where the remaining oil life is very low, the receiver may be notified of the need for additional oil or an oil change. Then, if the operator adds oil, the modified oil life may then be sent to the receiver to alert the operator or the communications network that the oil addition has extended the period until an oil change is needed.

Figure 2:
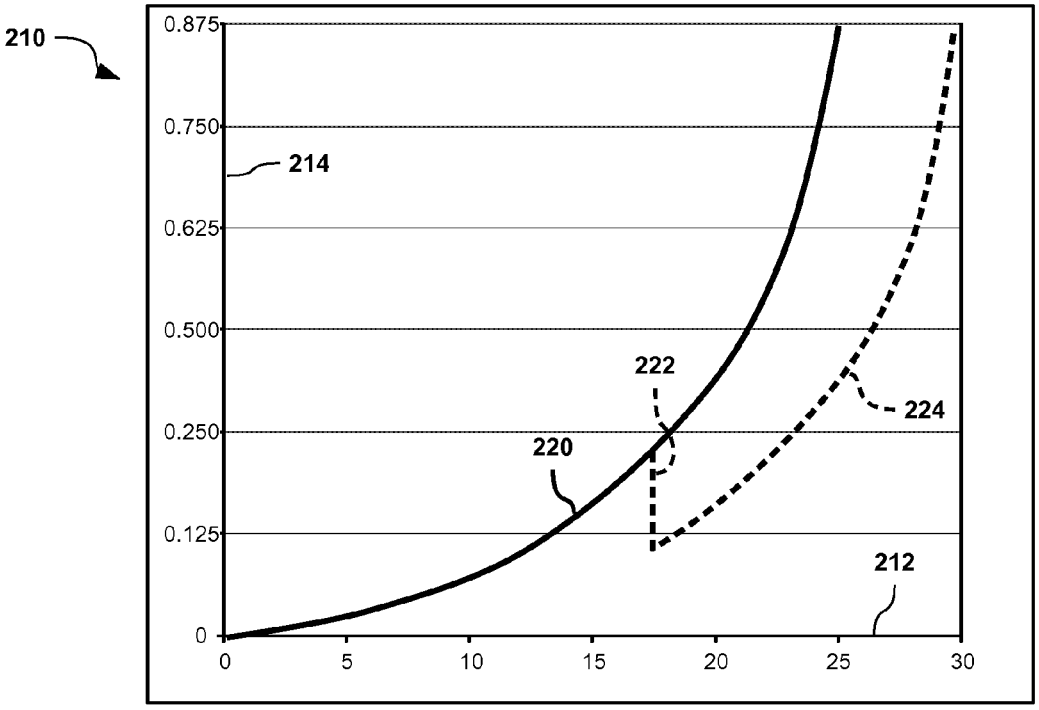
FIG. 2 is a schematic graph of oil quality as a function of lapse of time or event units.

Referring now to FIG. 2, and with continued reference to FIG. 1, there is shown a schematic graph 210 of oil quality as a function of event units. The x-axis 212 of the graph 210 shows event units being counted by, for example, the controller in step 120. The y-axis 214 of the graph 210 shows oil quality, as measured on the GODI.

A line 220 is an approximation of the relationship between oil quality and event units following an oil change, and may be a trendline approximating individual data points. The fresh oil begins at a value of 0.0 on the GODI. If the effective life cycle of the oil is said to run from 0.0 to 0.5 on the y-axis 214, then the line 220 illustrates that this oil has an original life of approximately 20-21 event units. Note that the event unit values shown on y-axis 214 may be greatly scaled, and may not be directly proportional when different types of event units are used.

In the illustrative graph 210 shown, an oil addition 222 is shown as a vertical line segment. The subsequent modified oil life or modified oil quality is shown on a line 224. This oil addition represents an addition credit of approximately 0.25. For example, the operator may have added one quart of oil to replenish an engine having a four-quart sump volume.

When the oil addition 222 occurred, there were approximately 3-4 event units remaining (around 15-20% remaining of the original oil life). However, after the oil addition, approximately 5 additional event units are added to the effective life span of the oil. Therefore, the modified oil life is approximately 8-9 event units, and the vehicle may run for approximately 25-26 event units between oil changes.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A method of monitoring oil in a vehicle having an internal combustion engine, the method comprising:

setting an original oil life, wherein the original oil life is measured by event units occurring in the engine;

measuring a lapse of the event units;

calculating a remaining oil life as a function of the lapse of event units and the original oil life, wherein the remaining oil life is expressed in terms of the event units;

monitoring an oil addition;

calculating an addition credit from the monitored oil addition, wherein the addition credit is calculated by determining the proportion of the monitored oil addition relative to a sump volume of the engine; and calculating a modified oil life as a function of the addition credit, wherein the modified oil life is expressed in terms of the event units and is determined by adding event units to the remaining oil life as a function of the addition credit.

2. The method of claim 1, wherein the modified oil life is equal to the remaining oil life plus the addition credit multiplied by the original oil life.

3. The method of claim 2, wherein the event units are one of engine revolutions and combustion events.

4. The method of claim 3, further comprising alerting a receiver of the modified oil life.

5. The method of claim 4, wherein the monitoring the oil addition includes receiving a signal from an operator of the vehicle.

6. A method of monitoring oil in a vehicle having an internal combustion engine, the method comprising:

setting an original oil life, wherein the original oil life is measured by event units occurring in the engine;

measuring a lapse of the event units;

calculating a remaining oil life as a function of the lapse of event units and the original oil life, wherein the remaining oil life is expressed in terms of the event units;

monitoring an oil addition;

calculating an addition credit from the monitored oil addition, wherein the addition credit is calculated by determining the proportion of the monitored oil addition relative to a sump volume of the engine; and calculating a modified oil life as a function of the addition credit, wherein the modified oil life is expressed in terms of the event units.

7. The method of claim 6, wherein the modified oil life is equal to the remaining oil life plus the addition credit multiplied by the original oil life.

8. The method of claim 7, further comprising alerting a receiver of the modified oil life.

9. The method of claim 8, wherein the event units are one of engine revolutions and combustion events.

10. The method of claim 9, wherein the monitoring the oil addition includes receiving a signal from an operator of the vehicle.

* * * * *